US006631560B2

(12) United States Patent
Imai

(10) Patent No.: US 6,631,560 B2
(45) Date of Patent: Oct. 14, 2003

(54) METHOD OF FORMING CONNECTOR PRESS-CONNECTING TERMINAL

(75) Inventor: Yujiro Imai, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/941,830

(22) Filed: Aug. 30, 2001

(65) Prior Publication Data

US 2002/0031957 A1 Mar. 14, 2002

(30) Foreign Application Priority Data

Sep. 14, 2000 (JP) ..... 2000-279099

(51) Int. Cl.[7] ..... H04R 43/04

(52) U.S. Cl. ..... 29/881; 29/881; 29/884; 29/874

(58) Field of Search ..... 29/33 M, 33 F, 29/34 D, 874, 881, 882, 884; 439/852, 397; 72/379.2

(56) References Cited

U.S. PATENT DOCUMENTS

| | | | | | |
|---|---|---|---|---|---|
| 4,940,425 | A | | 7/1990 | Hass et al. | |
| 5,007,865 | A | * | 4/1991 | Jakobeit | 439/839 |
| 5,380,218 | A | * | 1/1995 | Yamamoto et al. | 439/395 |
| 5,588,868 | A | * | 12/1996 | Tsuji et al. | 439/397 |
| 5,709,565 | A | * | 1/1998 | Okamoto | 439/395 |
| 5,879,181 | A | * | 3/1999 | Okabe | 439/397 |
| 5,913,695 | A | * | 6/1999 | Okabe | 439/397 |
| 5,921,804 | A | * | 7/1999 | Nagai | 439/397 |
| 5,980,300 | A | * | 11/1999 | Okabe | 439/397 |
| 6,007,365 | A | * | 12/1999 | Atsumi et al. | 439/397 |
| 6,012,942 | A | * | 1/2000 | Volstorf | 439/397 |
| 6,033,255 | A | * | 3/2000 | Murofushi | 439/397 |
| 6,155,865 | A | * | 12/2000 | Abe | 439/397 |
| 6,206,721 | B1 | * | 3/2001 | Ishida | 439/397 |
| 6,283,802 | B1 | * | 9/2001 | Sato et al. | 439/843 |
| 6,296,512 | B1 | * | 10/2001 | Akeda | 439/397 |

* cited by examiner

*Primary Examiner*—Carl J. Arbes
*Assistant Examiner*—Tai Nguyen
(74) *Attorney, Agent, or Firm*—Oliff & Berridge, PLC

(57) ABSTRACT

In a method of forming a connector press-connecting terminal 10 including a pair of opposed press-connecting blades 22R and 22L (24R and 24L) formed respectively on opposite right and left side wall plates 20R and 20L thereof formed by a metal sheet, the press-connecting blades being adapted to be electrically press-connected to a connection end portion of a cable L in a gripping manner. In this method, cuts 30 are formed respectively in press-connecting blade-forming portions of the flat metal sheet beforehand plated with an electrically-conductive material, and subsequently a plurality of drawing operations are applied to the press-connecting blade-forming portion at each of the cut portions 30 sequentially from the proximal end portion of the press-connecting blade 22R, 22L (24R, 24L) to the distal end portion thereof, thereby forming the press-connecting blade of a bent shape. Subsequently, the metal sheet is press-bent along two longitudinal lines, passing respectively through the cut portions 30, so that the opposite right and left side wall plates 20R and 20L, having the opposed press-connecting blades 22R and 22L (24R and 24L), respectively, are formed upright respectively at the opposite side edges of a bottom wall plate 18.

7 Claims, 5 Drawing Sheets

METHOD OF FORMING CONNECTOR PRESS-CONNECTING TERMINAL

BACKGROUND OF THE INVENTION

1. Technical Field

This invention relates to a method of forming a connector press-connecting terminal, and more particularly to a method of forming a press-connecting terminal (press-connecting blades) provided in a press-connecting connector, to which a conductor of a cable is electrically press-connected.

2. Related Art

Typical examples of known conventional connector press-connecting terminals of the type described are shown in FIGS. 5 and 6, respectively. In the press-connecting terminal 50 shown in FIG. 5, a pair of press-connecting blades 52*a* and 52*b* are disposed in opposed relation to each other, and a plating treatment is applied to contact surfaces (encircled by a broken line in this Figure) of these blades in order to enhance the reliability of the connection to a cable. In this case, there are also the type of products to which the plating treatment is not applied.

In the press-connecting terminal 60 shown in FIG. 6, upstanding opposite (right and left) side wall plates, formed by pressing a metal sheet, are inwardly bent at their respective intermediate portions by press working to provide a pair of opposed press-connecting blades 62*a* and 62*b*, respectively. In this case, also, a plating treatment is usually applied to the surface of the metal sheet.

3. Problems to be Solved

In the former terminal shown in FIG. 5, in accordance with the required performance, the plating need to be applied to the contact surfaces of the two press-connecting blades 52*a* and 52*b* for contact with a conductor of the cable. In this case, after the press-shaping operation, the plating treatment is applied (that is, the intermediate- or the post-plating is needed), and therefore the cost increases.

On the other hand, in the latter terminal shown in FIG. 6, the plating is beforehand applied to the metal sheet, and therefore the cost is reduced. However, in the press working, the metal sheet is pressed merely once (one shot) or a plurality of times in a die, and therefore a distal end portion of each of the press-connecting blades 62*a* and 62*b* is thinned as shown in FIG. 7, or is susceptible to cracking, and besides there has been encountered a problem that the plated surfaces of these portions are much roughened.

SUMMARY OF THE INVENTION

It is an object of this invention to provide a method of forming a connector press-connecting terminal by press-shaping a metal sheet, beforehand plated with an electrically-conductive material, in which each press-connecting blade is not reduced in thickness at its distal end, but has a uniform thickness, and the surface of the press-connecting blade is finished into a good condition free from cracking, plated-surface roughening and so on. With this method, the invention seeks to stabilize the quality of the product (i.e., the connector press-connecting terminal member), to secure a properly press-connected condition of a cable, and to enhance the yield rate of the products.

[Means for Solving the Problems]

According to the present invention, there is provided a method of forming a connector press-connecting terminal including a pair of opposed press-connecting blades formed respectively on opposite right and left side wall plates thereof formed by a metal sheet, the press-connecting blades being adapted to be electrically press-connected to a connection end portion of a cable in a gripping manner; CHARACTERIZED in that the method comprises the steps of:

forming cuts respectively in press-connecting blade-forming portions of the flat metal sheet beforehand plated with an electrically-conductive material;

applying a plurality of drawing operations to the press-connecting blade-forming portion at each of the cut portions sequentially from a proximal end portion of the press-connecting blade to a distal end portion thereof, thereby forming the press-connecting blade of a bent shape; and press-bending the metal sheet along two longitudinal lines, passing respectively through the cut portions, so that the opposite right and left sidewall plates, having the opposed press-connecting blades, respectively, are formed upright respectively at opposite side edges of a bottom wall plate of the terminal.

In this case, the cuts are not particularly limited to any special configuration, and may have merely a slit-like configuration, or may be in the form of a stamped-out triangular hole corresponding to the bent shape of the press-connecting blade. In the case of using the stamped-out triangular hole, any protrusion is not formed on the bottom wall plate when the press-connecting blade of the bent shape is formed, and this is pleasing in appearance.

Preferably, the press-connecting blade-forming step comprises the drawing of the proximal end portion of the press-connecting blade to be formed into the bent shape, the drawing of an intermediate portion of the press-connecting blade, and the drawing of the distal end portion of the press-connecting blade, and these drawing operations are carried out such that a curvature of the distal end portion of the press-connecting blade is gradually reduced.

In the drawing of the press-connecting blade by press-shaping, the drawing of the proximal end portion of the press-connecting blade, disposed near to the cut portion, is first effected, and subsequently the intermediate portion of the bent press-connecting blade is effected, and finally the drawing of the distal end portion of the press-connecting blade is effected. Thus, the plastically-deformed portions of the metal sheet are sequentially shifted from the proximal end portion of the press-connecting blade to the distal end portion thereof, and therefore the abrupt plastic deformation of the press-connecting blade portion is avoided, and besides the press-connecting blade of a uniform thickness is formed. However, the drawing does not need to be effected in a three-stage process, but the press-connecting blade may be finished in a two-stage process, or a four- or more stage drawing process can be used, depending on the amount (degree) of projection of the press-connecting blade.

Preferably, the metal sheet is cut obliquely to a plane thereof so that the press-connecting blade can have such a contour that an apex end surface of the press-connecting blade, formed on each of the opposite right and left side wall plates, becomes a slanting surface slanting inwardly downwardly relative to the bottom wall plate of the terminal. Therefore, in the operation for press-connecting the cable, the cable can be smoothly inserted between the opposed press-connecting blades, and can be positively and firmly press-connected to the two press-connecting blades in a fitted manner.

The connector press-connecting terminal member, produced by this production method, can be used as a terminal for press-connection to various cables including a coaxial cable and a parallel paired cable.

DETAILED DESCRIPTION OF THE PREFERRED EMBODIMENTS

[Mode for Carrying Out the Invention]

One preferred embodiment of the present invention will now be described in detail with reference to the drawings.

Figure 1:
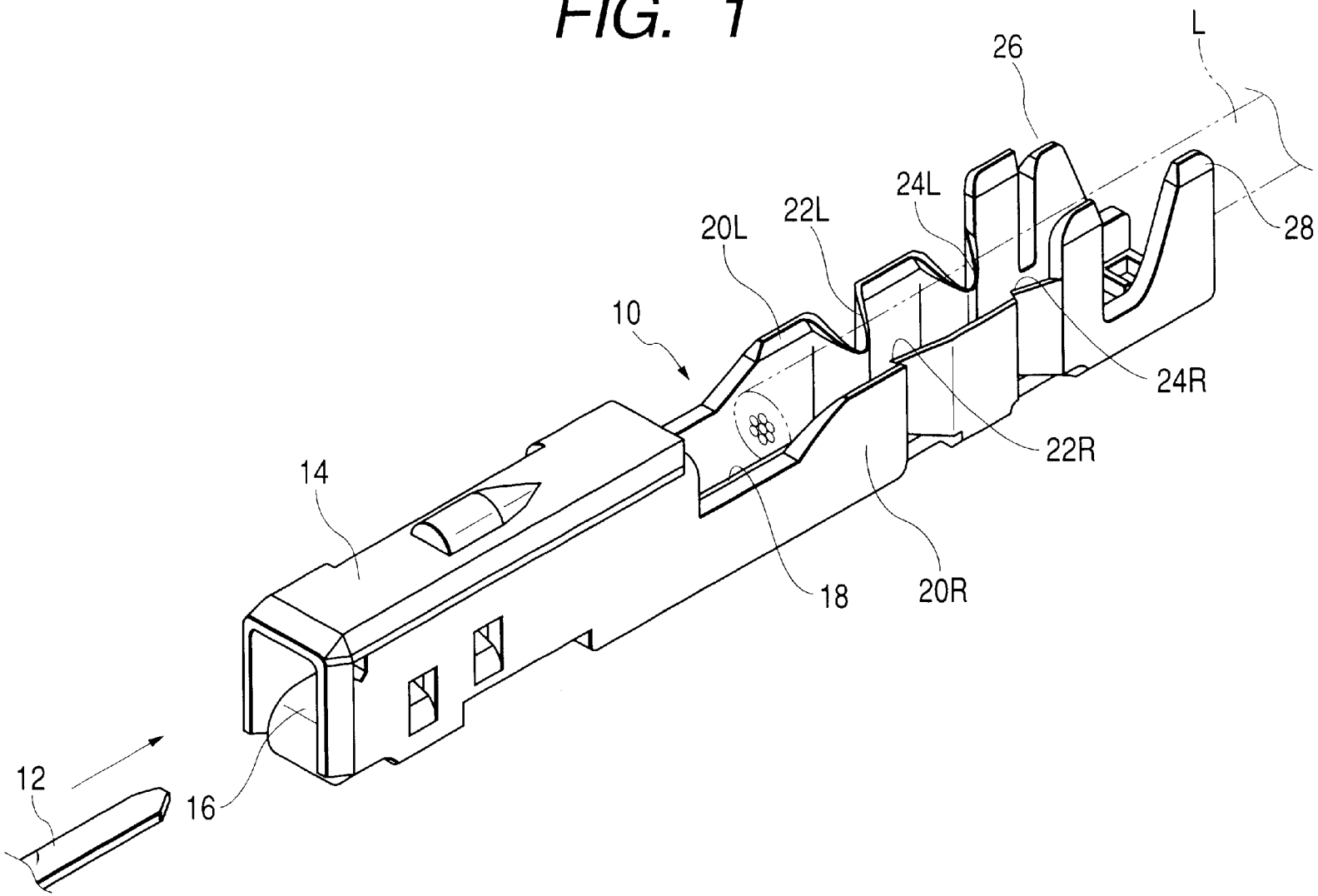
FIG. 1 is a perspective view showing the appearance of one preferred embodiment of a connector press-connecting terminal member of the present invention.
Figure 2:
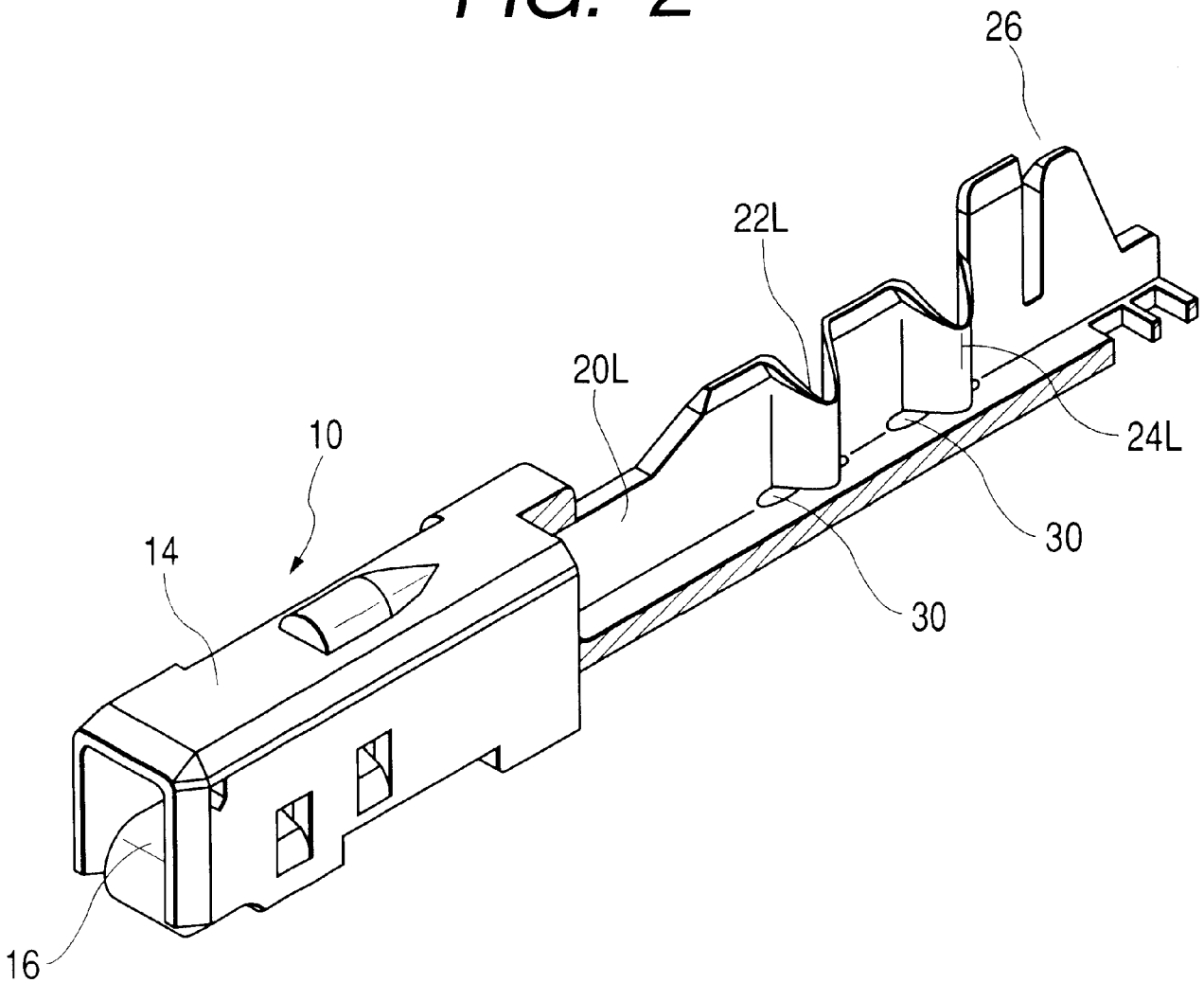
FIG. 2 is a perspective view of the connector press-connecting terminal member of FIG. 1, showing an important portion thereof as being broken.

FIG. 1 is a perspective view showing the appearance of a connector press-connecting terminal member of this embodiment, FIG. 2 is an appearance view showing an important portion thereof as being broken. Here, this embodiment is directed to the connector press-connecting terminal member adapted to be press-connected to a coaxial cable L. The illustrated connector press-connecting terminal member 10 is formed by press-shaping, that is, blanking and bending a metal sheet, beforehand plated with an electrically-conductive material.

This connector press-connecting terminal member 10 is used in a female connector, and is mounted in a connector housing (not shown). A male connector-connecting casing 14 of a square tubular shape for receiving a mating male connector terminal 12 is formed at the terminal member 10 so that the male connector terminal 12 can be releasably mounted in the terminal member 10 through one open end thereof. Although not clearly seen from FIG. 1, a connection terminal 16 in the form of a metal leaf spring is provided within the male connector-connecting casing 14, and is formed on an inner surface of this casing 14 so as to hold the male connector terminal 12 in electrically-connected relation thereto.

Opposed upstanding walls 20R and 20L extend from the male connector-connecting casing 14, and are formed respectively at opposite side edges of a bottom wall plate 18, and a pair of press-connecting blades 22R and 22L, inwardly bent toward each other, are formed respectively at opposed portions of the upstanding wall plates 20R and 20L, and another pair of press-connecting blades 24R and 24L, inwardly bent toward each other, are formed respectively at opposed portions of the upstanding wall plates 20R and 20L. Insulation barrels 26 and 28 for gripping and holding a sheath of a connection end portion of the cable L are formed at the other end portion of the connector press-connecting terminal member 10 remote from the male connector-connecting casing 14.

The connection end portion of the cable L is attached to the connector press-connecting terminal member 10 from the upper side thereof as shown in phantom in FIG. 1, and are press-connected to the two pairs of press-connecting blades 22R, 22L and 24R, 24L in electrically-connected relation thereto, and this cable can be gripped and held against withdrawal by press-deforming the insulating barrels 26 and 28.

For preparing this connector press-connecting terminal member 10, in a first step, cuts 30 are formed respectively in press-connecting blade-forming portions of the flat metal sheet, beforehand plated with the electrically-conductive material, as shown in FIG. 2. These cuts 30 are not particularly limited to any special configuration, and can have a slit-like configuration as in the illustrated embodiment, or can have any other suitable shape such for example as a triangular hole-shape corresponding to the shape of the press-connecting blade.

FIG. 3 shows the step of forming the press-connecting blade by drawing (press-shaping), which is a second step. First, the metal sheet, shown in FIG. 3A, is drawn at a proximal end portion of each press-connecting blade 22, 24 by a die and a punch as shown in FIG. 3B. Then, as shown in FIG. 3C, an intermediate portion of the press-connecting blade is drawn, using a lower die having an end portion for forming the distal end portion of the press-connecting blade smaller in curvature R than that formed in the step of FIG. 3B. In each of the drawing steps of FIGS. 3B and 3C, a small space is provided in the upper die in preparation for the drawing of the distal end portion in the subsequent step.

Figure 3A:
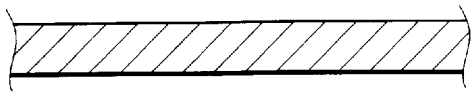
FIGS. 3A to 3D are views showing the process of drawing a press-connecting blade in a plurality of steps by press working.
Figure 3B:
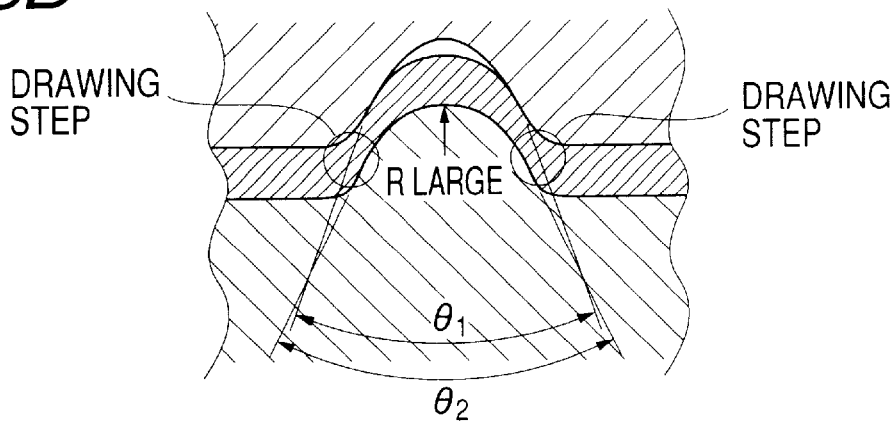
Figure 3C:
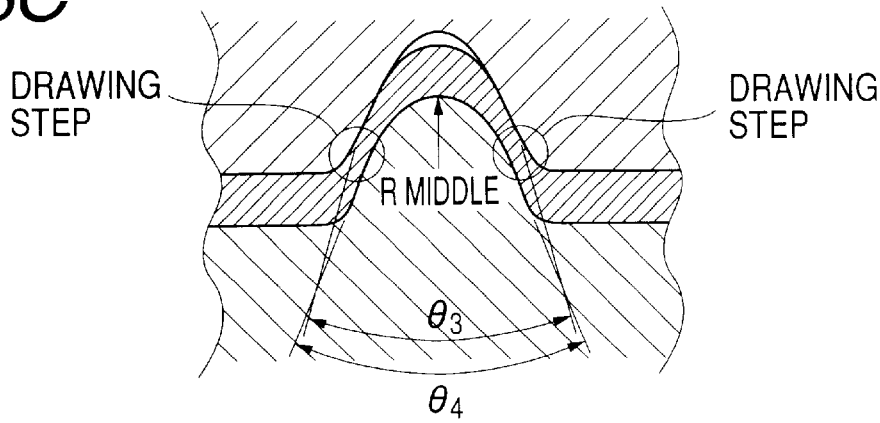
Figure 3D:
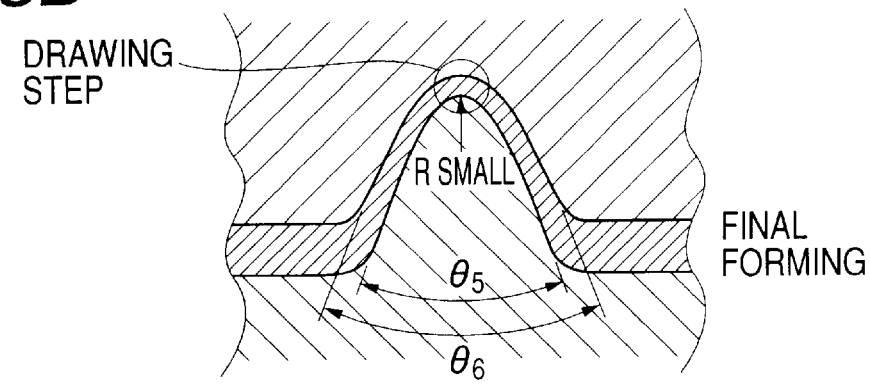

Finally, as shown in FIG. 3D, the distal end portion of the press-connecting blade is drawn, using a lower die having an end portion for forming the distal end portion of the press-connecting blade having a smaller curvature R. With respect to the drawing angles shown in the drawings, the relations, $\theta_2>\theta_4>\theta_6$, $\theta_1<\theta_2$, $\theta_3<\theta_4$, and $\theta_5=\theta_6$, are established. Therefore, the curvature R of the distal end portion of each press-connecting blade is gradually decreased, and finally the press-connecting terminal of the predetermined shape is formed.

Thus, the plastic working of the press-connecting blade is carried out in the plurality of (three in this embodiment) drawing steps sequentially from the proximal end portion thereof to the distal end portion thereof, and therefore the thickness of the press-connecting blade is uniform over the entire area from the proximal end portion to the distal end portion. And besides, since abrupt plastic deformation will not occur at the distal end portion of the press-connecting blade, any cracks will not develop in the surface of the material, and the roughening of the plated surface can be suppressed.

After the press-shaping of the press-connecting blades is thus finished, the metal sheet is bent by pressing along two longitudinal lines each passing through the corresponding cut portions, and as a result there is formed the connector press-connecting terminal member 10 (shown in FIGS. 1 and 2) having the two pairs of opposed press-connecting blades 22R, 22L and 24R and 24L. In this press-shaping process, although the blanking and bending for forming the male connector-connecting casing 14, as well as the blanking and bending for forming the insulation barrels 26 and 28, are effected, these do not bear any direct relation to the subject matter of the present invention, and therefore description thereof is omitted here.

Figure 4A:
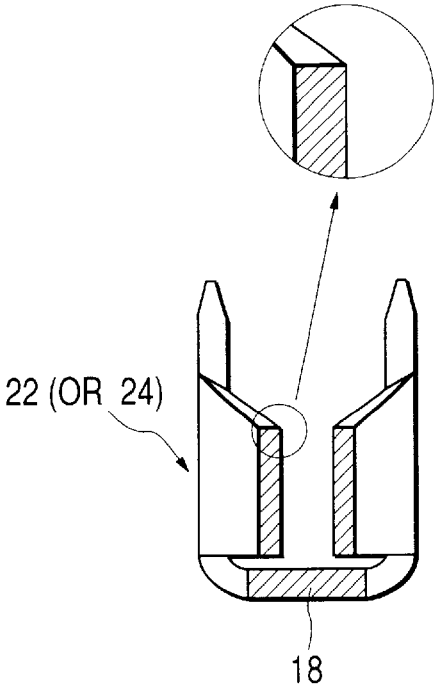
FIGS. 4A and 4B are views showing the cross-section of the press-connecting blade of the connector press-connecting terminal of FIGS. 1 and 2.
Figure 4B:
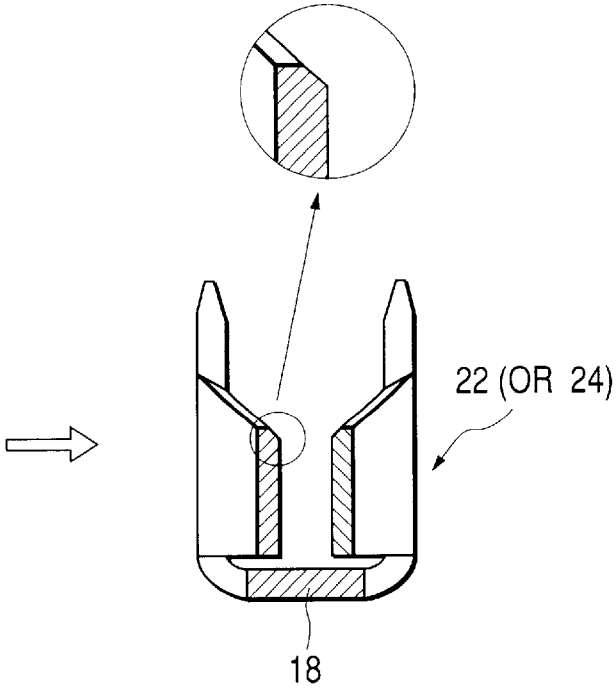
Figure 5:
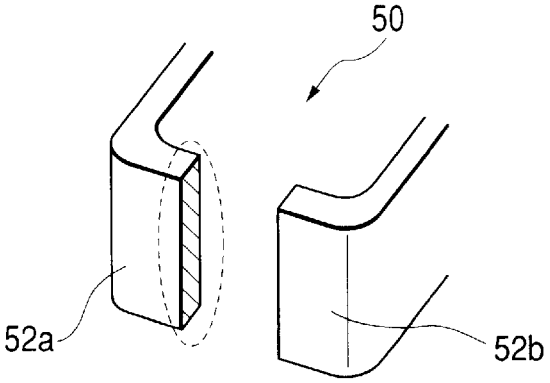
FIG. 5 is a view showing press-connecting blades of a known conventional press-connecting terminal member.
Figure 6:
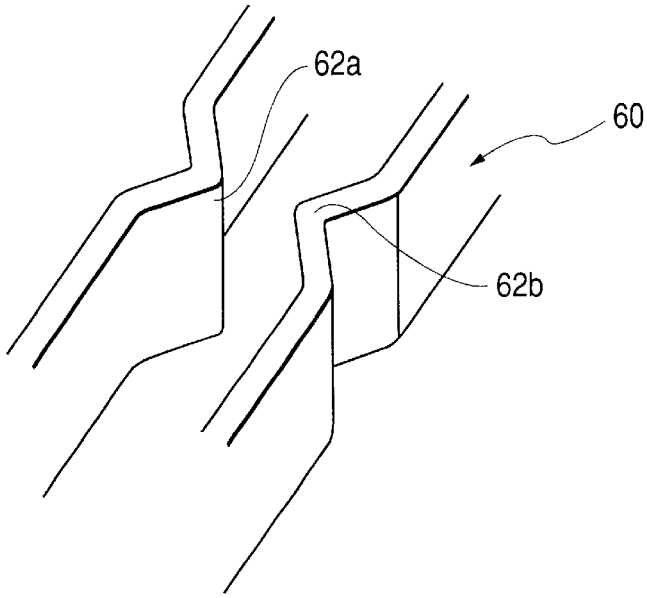
FIG. 6 is a view showing press-connecting blades of another known conventional press-connecting terminal member.
Figure 7A:
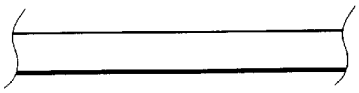
FIGS. 7A and 7*b* are views explaining a conventional method of press-shaping the press-connecting blade of the press-connecting terminal member of FIG. 6.
Figure 7B:
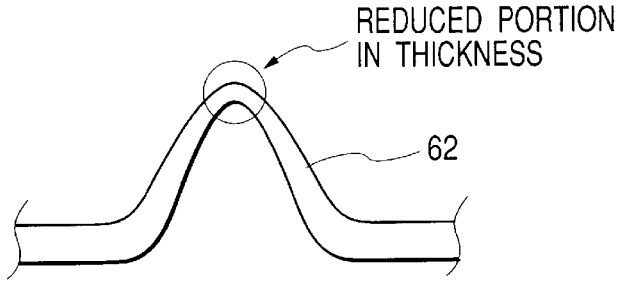

FIGS. 4A and 4B show the cross-section of the tapering surface portion of each press-connecting blade 22R, 22L, 24R, 24L at the apexes thereof. In the case where the metal sheet is merely cut (by blanking) in a direction perpendicular to the plane of this metal sheet, an apex end surface of each press-connecting blade becomes a straight surface substantially parallel to the bottom wall plate 18 as shown in FIG. 4A when the blanked metal sheet is press-shaped.

Therefore, when blanking the metal sheet, the metal sheet is cut obliquely to the plane thereof. As a result, when this blanked metal sheet is press-shaped, the apex end surface of each press-connecting blade becomes a slanting surface slanting inwardly downwardly relative to the bottom wall plate 18 as shown in FIG. 4B. The apex end surface of the press-connecting blade thus provides the inwardly-slanting surface, and therefore, the connection end portion of the cable L can be easily inserted between each pair of press-connecting blades 22R and 22L (24R and 24L).

The present invention is not limited to the above embodiment, and various modifications can be made without departing from the scope of the invention. For example, although one connector press-connecting terminal member for the coaxial cable is shown in the above embodiment, the two connector press-connecting terminal members can be arranged in parallel relation to each other in the case where a parallel paired cable is used. And besides, the connector press-connecting terminal member can be changed in design in various ways.

[Effects of the Invention]

In the present invention, there is provided the method of forming the connector press-connecting terminal including the pair of opposed press-connecting blades formed respectively on the opposite right and left side wall plates thereof formed by the metal sheet, the press-connecting blades being adapted to be electrically press-connected to the connection end portion of the cable in a gripping manner. In this method, the cuts are formed respectively in the press-connecting blade-forming portions of the flat metal sheet beforehand plated with an electrically-conductive material, and subsequently the plurality of drawing operations are applied to the press-connecting blade-forming portion at each of the cut portions sequentially from the proximal end portion of the press-connecting blade to the distal end portion thereof, thereby forming the press-connecting blade of the bent shape. Subsequently, the metal sheet is press-bent along two longitudinal lines, passing respectively through the cut portions, so that the opposite right and left side wall plates, having the opposed press-connecting blades, respectively, are formed upright respectively at the opposite side edges of the bottom wall plate of the terminal. Therefore, the press-connecting blade will not be reduced in thickness at its distal end portion, but has a uniform thickness, and besides the surface of the press-connecting blade is finished into a good condition free from cracking, plated-surface roughening and so on.

Therefore, when the connection end portion of the cable is press-connected to the pair of press-connecting blades in a fitted manner, the reduced press-connecting strength due to the reduced material strength of the distal end portion of the press-connecting terminal is avoided, and also the incomplete electrical connection due to cracking, plated-surface roughening and so on, developing on the surface of the press-connecting blade, is avoided, and therefore there is achieved an advantage that the stable product quality is obtained.

What is claimed is:

1. A method of forming a connector press-connecting terminal including a pair of opposed press-connecting blades formed respectively on opposite right and left side wall plates thereof formed by a metal sheet, said press-connecting blades being adapted to be electrically press-connected to a connection end portion of a cable in a gripping manner;

said method comprising the steps of:

forming cuts respectively in press-connecting blade-forming portions of said metal sheet, which has been beforehand plated with an electrically-conductive material;

applying a plurality of drawing operations to said press-connecting blade-forming portion at each of said cut portions sequentially from a proximal end portion of said press-connecting blade to a distal end portion thereof, such that a second drawing operation and any subsequent drawing operations each act on a portion of said press-connecting blade that is farther away from a plane of said sheet metal than a portion acted on by a dircectly preceding drawing operation, to form said press-connecting blade of a bent shape; and press-bending the metal sheet along two longitudinal lines, passing respectively through said cut portions, so that said opposite right and left side wall plates, having said opposed press-connecting blades, respectively, are formed upright respectively at opposite side edges of a bottom wall plate of said terminal.

2. The method of forming a connector press-connecting terminal according to claim 1, wherein said press-connecting blade-forming step comprises:

drawing of the proximal end portion of said press-connecting blade, drawing of an intermediate portion of said press-connecting blade, and drawing of the distal end portion of said press-connecting blade, and wherein the drawing operations are carried out in a manner that a curvature of the distal end portion of said press-connecting blade is gradually reduced.

3. The method of forming a connector press-connecting terminal according to claim 1, wherein said metal sheet is cut obliquely to a plane thereof prior to the step of press-bending so that, after the step of press-bending, an upper end of said press-connecting blade, formed on each of said opposite right and left side wall plates, includes a slanting surface slanting inwardly downwardly relative to said bottom wall plate of said terminal.

4. The method of forming a connector press-connecting terminal according to claim 1, wherein said plurality of drawing operations comprises a first drawing operation applied using a first punch having first distal end radius, a second drawing operation following the first drawing operation and applied using a second punch having a second distal end radius smaller than the first distal end radius, and a third drawing operation following the first and second drawing operations and applied using a third punch having a third distal end radius smaller than the second distal end radius.

5. The method of forming a connector press-connecting terminal according to claim 1, wherein the plurality of drawing operations are performed by a set of punches including at least first, second and third punches, opposite side surfaces of the first punch define an angle $\theta_2$ and the first punch operates in conjunction with a first cavity with opposite side walls that define an angle $\theta_1$, opposite side surfaces of the second punch define an angle $\theta_4$ and the second punch operates in conjunction with a second cavity with opposite side walls that define an angle $\theta_3$, and opposite side surfaces of the third punch define an angle $\theta_5$ and the second punch operates in conjunction with a second cavity with opposite side walls that define an angle $\theta_6$, and the relations $\theta_2>\theta_4>\theta_6$, $\theta_1<\theta_2$, $\theta_3<\theta_4$, and $\theta_5=\theta_6$, are established.

6. A method of forming a connector press-connecting terminal including a pair of opposed press-connecting blades formed respectively on opposite right and left side wall plates thereof formed by a metal sheet, said press-connecting blades being adapted to be electrically press-connected to a connection end portion of a cable in a gripping manner;

said method comprising the steps of:

forming cuts respectively in press-connecting blade-forming portions of said flat metal sheet, which has been beforehand plated with an electrically-conductive material;

applying a plurality of drawing operations to said press-connecting blade-forming portion at each of said cut portions sequentially from a proximal end portion of said press-connecting blade to a distal end portion thereof, to form said press-connecting blade of a bent shape; and press-bending the metal sheet along two longitudinal lines, passing respectively through said cut portions, so that said opposite right and left side wall plates, having said opposed press-connecting blades, respectively, are formed upright respectively at opposite side edges of a bottom wall plate of said terminal, wherein said metal sheet is cut obliquely to a plane thereof so that an upper end of said press-connecting blade, formed on each of said opposite right and left side wall plates, includes a slanting surface slanting inwardly downwardly relative to said bottom wall plate of said terminal.

7. The method of forming a connector press-connecting terminal according to claim 6, wherein said metal sheet is cut obliquely to the plane thereof prior to the step of press-bending so that, after the step of press-bending, the upper end of said press-connecting blade, formed on each of said opposite right and left side wall plates, includes the slanting surface slanting inwardly downwardly relative to said bottom wall plate of said terminal.

* * * * *